US005103904A

United States Patent [19]

Luke et al.

[11] Patent Number: 5,103,904

[45] Date of Patent: Apr. 14, 1992

[54] SEALING ASSEMBLY FOR SUBTERRANEAN WELL PACKING UNIT

[75] Inventors: Mike A. Luke, Pasadena; Patrick C. Stone, Houston, both of Tex.

[73] Assignee: Baker Hughes Incorporated, Houston, Tex.

[21] Appl. No.: 701,622

[22] Filed: May 14, 1991

Related U.S. Application Data

[63] Continuation of Ser. No. 401,664, Aug. 31, 1989, abandoned.

[51] Int. Cl.[5] ..... E21B 33/12

[52] U.S. Cl. ..... 166/195; 166/196

[58] Field of Search ..... 166/119, 132, 135, 141, 166/179, 192, 195-196

[56] References Cited

U.S. PATENT DOCUMENTS 3,036,639 5/1960 Baker ..... 166/134

4,745,972 5/1988 Bell et al. ..... 166/196

*Primary Examiner*—Ramon S. Britts

*Assistant Examiner*—Roger J. Schoeppel

*Attorney, Agent, or Firm*—Melvin A. Hunn

[57] ABSTRACT

In subterranean wells, it is common to effect the radial expansion of an annular organic sacking element into sealing engagement between a tubular inner body and the inner wall of a well conduit, such as a well casing. Extrusion of the organic material has been encountered between the inner surface of upper and lower cone elements and the exterior of a tubular body portion and also between the inclined surfaces of upper and lower cone elements and the cooperating surfaces of cone rings. The first mentioned extrusion path is eliminated by forming a generally radial surface on the inner end of the upper and lower cones orthogonal to the tubular body, and inserting a carbon fiber filled organic material in the resulting annular chamber. The extrusion path between the inclined surface of the cone and the cooperating surface of the cone ring is minimized by utilizing the forces exerted by the compressed sealing material of the packing element in combination with to effect the shearing of the inner vertex portion of a packer ring along a plane that corresponds exactly to the inclined surface of the cone ring.

4 Claims, 2 Drawing Sheets

SEALING ASSEMBLY FOR SUBTERRANEAN WELL PACKING UNIT

This application is a continuation-in-part, of application Ser. No. 401,664, filed 8/31/89, abandoned.

BACKGROUND OF THE INVENTION

1. Field of the Invention

The invention relates to an improved sealing assembly for a subterranean well packing unit, and particularly to a sealing assembly that minimizes extrusion of the organic sealing material commonly employed in such packing unit.

2. Summary of the Prior Art

As will be later described in connection with FIG. 1, prior art sealing assemblies have involved a packing sleeve formed of an organic sealing material which snugly surrounds the tubular body portion of a packer or bridge plug for a subterranean well. The packing sleeve is subjected to substantial compressive forces by upper and lower cone elements having oppositely disposed inclined surfaces. Intermediate the inclined surfaces of both the upper and lower cone elements and the original end surfaces of the packing sleeve, a cone ring and a packer ring are mounted. Both types of these rings have to be C-rings to permit their expansion. The cone ring has an inclined surface that is cooperable with the inclined surface on the adjacent cone. An annular groove and slot effects the connection of each cone ring to a mating packer ring. Each packer ring has an inclined surface which engages with the end surface of the packing sleeve.

As the upper and lower cones are moved axially relative to each other so as to bring them closer together, an increasing compressive force is applied to the packing sleeve. At the same time, the cone rings and packer rings are expanded radially outwardly by the inclined surfaces of the upper and lower cones.

When the packer or bridge plug is fully set and the packing sleeve is compressed between the exterior of the tubular body and the bore of a well conduit, the substantial compression forces on the organic packing element causes a gradual extrusion of the material of such element between the inner face of the upper and lower cones and the outer surface of the tubular body. An additional major extrusion path is provided between the packing ring the inclined surface of the cone ring, and the cooperating inclined surface of the respective upper or lower cone because of the C-ring construction of the cone ring. Such extrusion paths effect a gradual reduction in the compressive forces trapped in the organic packing element, hence reducing the sealing effectiveness of such element.

Numerous solutions have been proposed for this extrusion problem in the past, but none have been fully effective. There is a definite need therefore, for a sealing assembly which will effectively prevent extrusion of an organic packing element along the extrusion paths previously mentioned.

SUMMARY OF THE INVENTION

The invention employs a conventional tubular body on which are mounted upper and lower cone elements for relative axial movement. Between the cone elements a sleeve of any conventional organic, elastomeric sealing, or packing material is snugly mounted on the exterior of the tubular body. Each of the upper and lower cone elements have oppositely disposed inclined surfaces which, in the unset position of the sealing assembly, are not normally in engagement with the packing sleeve.

The two spaces intermediate the oppositely inclined surfaces on the upper and lower cones and the axial ends of the packing sleeve are each occupied by a cone ring and mating packer ring. The cone rings and packer rings are of C-ring construction. Each cone ring is of generally triangular cross-section and has an inclined surface that mates with the inclined surface on the adjacent one of the upper and lower cones. Each packer ring has an inclined surface engaged with the adjacent end face of the organic packing element in the unset position of the sealing assembly. An annular slot is provided in either the packer ring or cone ring and an annular groove cooperable with such slot is provided in the other of these rings, thus securing each cone ring and the adjacent packer ring for co-movement.

In accordance with this invention, each packer ring has a smaller internal diameter than the adjacent cone ring and is fabricated from a relatively soft metallic material. Thus, an inner vertex portion of the packer ring extends radially inwardly beyond the cone ring and, as compressive force is applied to the organic material of the packing sleeve, such material exerts a substantial force against such inner vertex portion, and in combination with the radial movement of the cones, readily effects the shearing off of such inner vertex portion along a plane that corresponds exactly to the inclination of the inclined surface of the adjacent cone element. Thus, as the cone rings and packer rings ride radially outwardly respectively on the upper and lower cones, the surface newly created by the shearing action effects a seal with the adjacent upper or lower cone ring and substantially reduces this extrusion path.

To further improve the anti-extrusion property of the sealing assembly, the extrusion paths between the tubular body 10 and the upper and lower cones 12 and 14 are sealed by inserting a pair of annular rings made of an extrusion resistant organic sealing material, such as polyetheretherketone, and having a triangular cross-section. Each of the two rings is inserted adjacent to the tubular body and either the upper or lower cones' innermose radial surfaces which are orthogonal to the tubular body. Thus, as the compression of the packing sleeve is effected by the relative movement of the upper and lower cones toward each other, the two extrusion resistant rings effect a sealing engagement between the radial inner surface provided on each of the upper and lower cones and the adjacent external surface of the tubular body. Thus, the second major path for extrusion loss of material of the organic packing element is effectively eliminated.

Further objects and advantages of the invention will be readily apparent to those skilled in the art from the following detailed description, in which is shown a preferred embodiment of the invention.

DESCRIPTION OF PREFERRED EMBODIMENT

Figure 1:
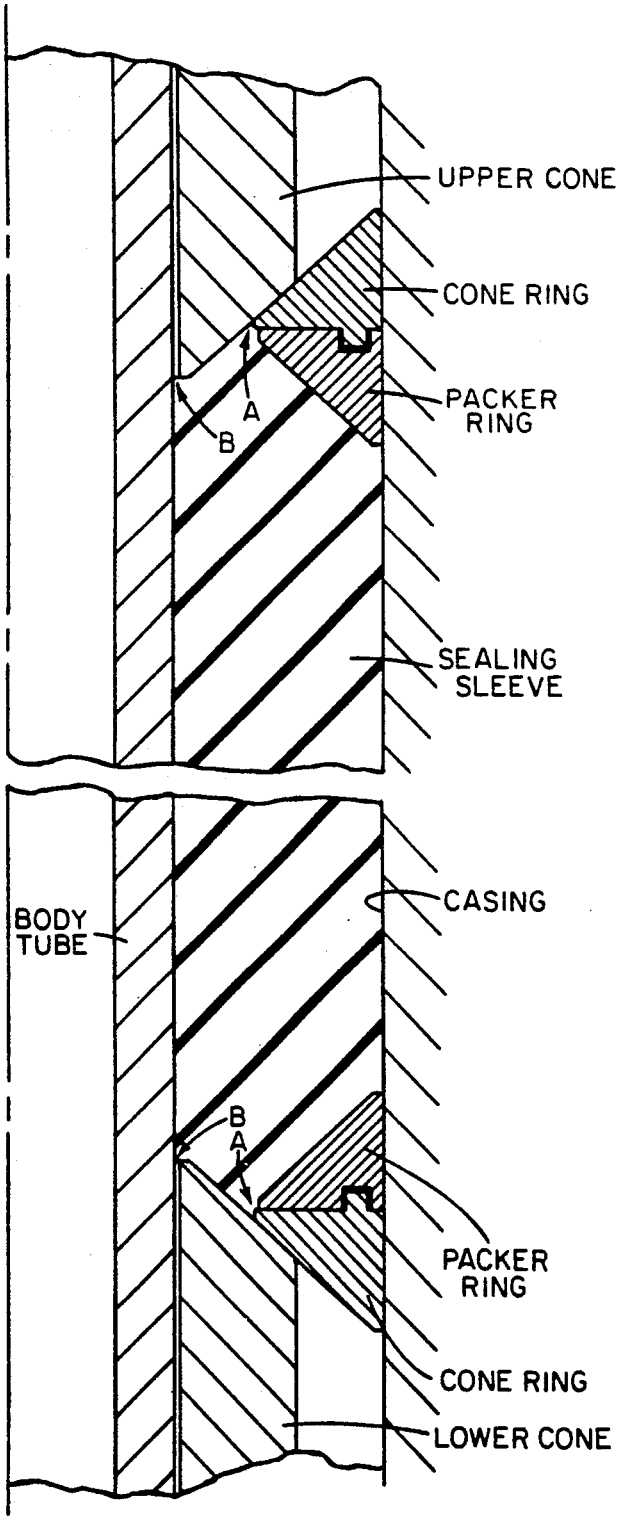
FIG. 1 (PRIOR ART)
FIG. 1 is a vertical quarter-sectional view of an existing sealing assembly for a subterranean well packing unit, on which the major seal extrusion leakage paths are indicated.

Referring to FIG. 1, there is illustrated a conventional sealing assembly for a packer or bridge plug employed in a subterranean well. The packing assembly is shown in its expanded position and a tubular mass of organic sealing material is compressed into packing engagement between the exterior of a body tube and the bore of a well conduit such as the casing. The compression of the organic sealing material is effected by relative movement of upper and lower cones toward each other which also effect the concurrent movements of upper and lower sets of cone rings and packer rings which are mounted between each axial end of the packing material and the respective upper or lower cone element. The cone rings and packer rings are necessarily of C-ring configuration because the cone rings each have an inclined surface engageable with a similarly shaped surface formed on the adjacent upper or lower cone element which expands the cone rings and packer rings outwardly. The packer ring is moved outwardly by the cone ring, inner engagement between the two rings is accomplished by means of engagement through an annular tongue and groove connection.

When the packing material is in its compressed condition, there are two major paths for extrusion of such material. The first path, indicated by the arrow A, is between the lower end of the packer ring and then through the C-ring opening of the cone ring.

The second major extrusion path, indicated by the arrow B, is between the internal surface of the upper and lower cones and the adjacent external surface of the tubular body on which such cones are mounted.

It is therefore readily apparent that in this prior art construction, a substantial quantity of the organic packing material may be extruded through the leakage paths A and B and thus the compressive forces existing in the packing material will be gradually reduced, thus reducing the sealing effectiveness of such material.

Figure 2:
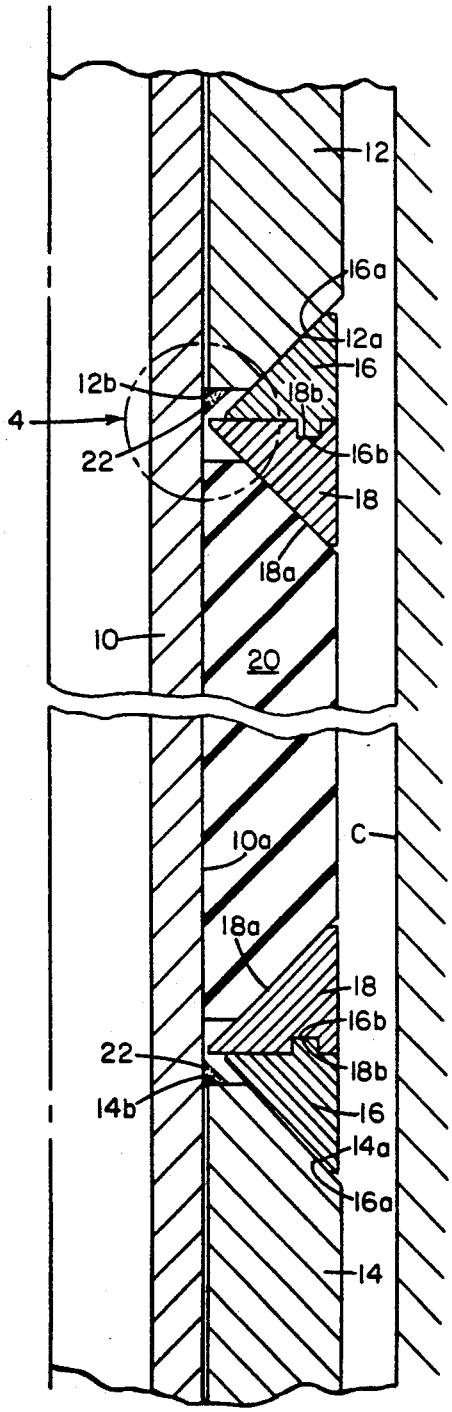
FIG. 2 is a vertical quarter-sectional view of a sealing assembly for a subterranean well packing unit embodying this invention, with the sealing assembly shown in its unset or uncompressed condition.
Figure 3:
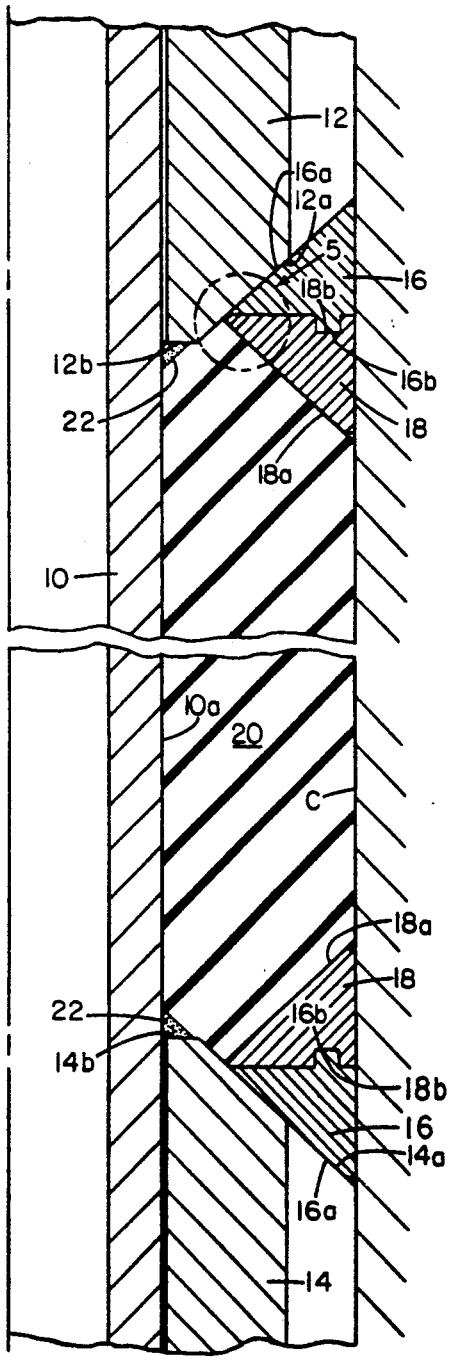
FIG. 3 is a view similar to FIG. 2 but showing the sealing assembly in its set or compressed position in engagement with the wall of a well conduit.

Turning now to FIGS. 2–5, a sealing assembly embodying this invention is illustrated. In FIG. 2, the sealing assembly is shown in its unset or uncompressed position, while in FIG. 3, the sealing assembly is shown in its set or compressed position.

The sealing assembly embodying this invention is comprised of a tubular body 10 of a packer, bridge plug or similar well tool, on the exterior surface of which is mounted an annular mass of an organic, elastomeric packing material 20, which when set snugly engages between the exterior external surface 10*a* of the tubular body 10 and the bore of a well conduit C. Such annular mass will hereinafter be referred to as a packing sleeve.

Adjacent each end of the packing sleeve 20, an upper cone 12 and a lower cone 14 are respectively provided. Such cone elements have oppositely inclined, facing surfaces 12*a* and 14*a*.

Intermediate each axial end of the packing sleeve 20, and the upper and lower cones 12 and 14, a pair of cooperating rings 16 and 18 are provided. The rings 16 are commonly referred to as cone rings and are of triangular shaped cross-section and have inclined surfaces 16*a* which conform to and are engaged by the inclined surfaces 12*a* and 14*a* of the upper and lower cones 12 and 14 respectively. The ring elements 18 are commonly referred to as packer rings and again are of triangular cross-sectional configuration and have opposed inclined surfaces 18*a* engageable with the opposite axial ends of the packing sleeve 20 as the upper and lower cones are moved relatively towards each other. Both the cone rings 16 and the packer rings 18 are constructed in a C-ring configuration to permit their radial expansion as the upper and lower cones 12 and 14 move toward each other. The cone rings 16 and packer rings 18 are connected for co-movement by an annular tongue or ridge 16*b* formed on the cone rings 16, and an annular groove 18*b* formed in the packer rings 18 and receiving the tongue or ridge 16*b* therein in snug fitting relationship.

In accordance with this invention, the radially innermost portion of the inclined surfaces 12*a* and 14*a* of the upper and lower cones 12 and 14 both terminate in radial surfaces 12*b* and 14*b* which are orthogonal to the exterior surface of the tubular body 10. Surfaces 12*b* and 14*b* cooperate with the adjacent orthogonal surface of the exterior of the tubular body 10 to define two annular chambers of triangular cross-section. Snugly inserted into each of the two annular chambers is a continuous auxiliary ring 22 made of an extrusion resistant organic sealing material. The material employed for the ring 22 is preferably polyetheretherketone which is filled with carbon fibers constituting on the order of 30% of the total mass of the ring 22. The carbon fiber filing of this material prevents extrusion.

Figure 4:
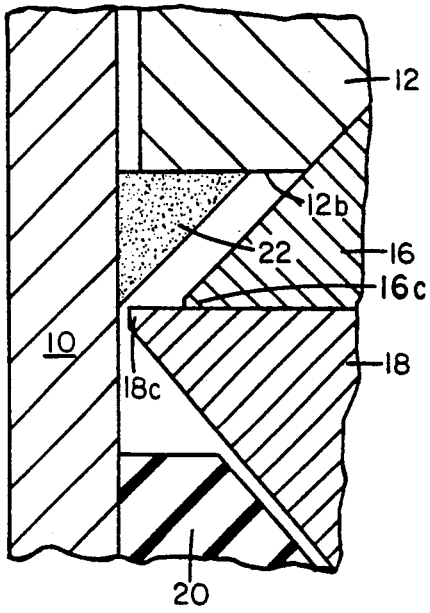
FIG. 4 is an enlarged view of that portion of FIG. 2 contained within the dotted line circle labelled 4.
Figure 5:
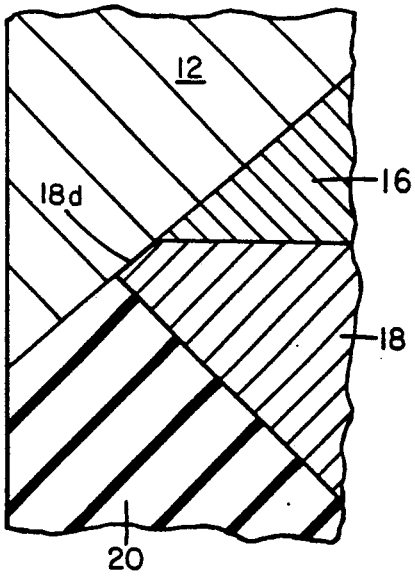
FIG. 5 is an enlarged view of that portion of FIG. 3 contained within the dotted line circle labelled 5.

It will be noted from FIGS. 2 and 4 that the inner end or the inner vertex portion 18*c* of each packer ring extends radially inwardly beyond the vertex 16*c* of the cone rings 16. This dimensional relationship is provided for a specific purpose that will become apparent when we turn to FIG. 3 which shows the seal assembly embodying this invention in its set or compressed position.

As the compressive forces are exerted on the packing sleeve 20 by the relative axial movement of the cones 12 and 14 toward each other, such compressive forces are transmitted by the packing sleeve 20 to the inner vertex portion 18*c* of the packer rings 18 as the cones 12 and 14 move into the packer rings 18. Since the packer ring 18 is formed of a relatively soft material, such as ductile iron, this inner vertex portion 18*c* will be sheared off in the manner indicated in FIG. 5 and the shearing will take place along a plane 18*d* that is exactly parallel to the inclination of the inclined surface 12*a* or 14*a* of the adjacent cone element 12 or 14 as the case may be. Thus, a seal is provided between all portions of the packer ring 18 and the inclined cone surfaces 12*a* or 14*a* except at the place where the opening in the C-ring configuration of the packer ring 18 exists. To seal these C-ring openings, the C-ring openings 18*e* (not shown) in the packer rings 18 are radially displaced 180° from the C-ring openings 16*e* (not shown) in the cone rings 16.

Of equal importance is the fact that the compressed organic material of the packing sleeve 20 will exert a force directly upon the auxiliary sealing ring 22 made of an extrusion resistant organic sealing material which prevents extrusion between the inner cylindrical surfaces of the cones 12 and 14 and the outer surface of the tubular body 10. The packing sleeve 20 is, of course, expanded into intimate engagement with the internal wall of a well conduit, such as the casing C.

It will therefore be readily apparent to those skilled in the art that a seal assembly embodying this invention effectively substantially reduces the extrusion paths for extrusion of an organic sealing element due to its compression by the upper and lower cones during the setting operation.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A sealing assembly for a subterranean well packing unit comprising in combination:

a tubular body element;

a packing sleeve formed of a deformable organic material and snugly surrounding an axial portion of the exterior of said tubular body element;

upper and lower cones freely surrounding said tubular body element at opposite axial ends of said packing sleeve and having oppositely inclined, facing surfaces respectively axially spaced from said packing sleeve;

a pair of cone C-rings respectively cooperable with said oppositely inclined surfaces on said upper and lower cones to be urged radially outwardly and axially toward each other by relative axial movement of said upper and lower cones toward each other, said cone C-rings respectively having generally radial, facing surfaces;

a pair of packer C-rings respectively secured to and abutting said facing surfaces of said cone C-rings, whereby the axial and radial movements of said cone C-rings are transferred to said packer C-rings;

said packer C-rings having opposed inclined surfaces respectively engageable with opposite axial ends of said packing sleeve, whereby axial movement of said upper and lower cones toward each other produce a compression of said packing sleeve to deform said packing sleeve radially and axially;

each said inclined surface on said packer C-rings forming an inner shearable vertex portion extending radially inwardly past the inner end of the adjacent said cone C-ring, whereby the compressive force generated by relative axial movement of said upper and lower cones toward each other effects a shearing of said vertex portion of each said packer C-ring to produce a surface on each said packer C-ring snugly conforming to the adjacent one of said oppositely surfaces on said upper and lower cones.

2. A sealing assembly for a subterranean well packing unit comprising, in combination:

a tubular body element;

a packing sleeve formed of a deformable organic material and snugly surrounding an axial portion of the exterior of said tubular body element;

upper and lower cones freely surrounding said tubular body element at opposite axial ends of said packing sleeve and having oppositely inclined, facing surfaces respectively axially spaced from said packing sleeve;

a pair of cone C-rings respectively cooperable with said oppositely inclined surfaces on said upper and lower cones to be urged radially outwardly and axially toward each other by relative axial movement of said upper and lower cones toward each other, said cone C-rings respectively having generally radial, facing surfaces;

a pair of packer C-rings respectively secured to and abutting said facing surfaces of said cone C-rings, whereby the axial and radial movements of said cone C-rings are transferred to said packer C-rings;

said packer C-rings having opposed inclined surfaces respectively engageable with opposite axial ends of said packing sleeve, whereby axial movement of said upper and lower cones toward each other produce a compression of said packing sleeve to deform said packing sleeve radially and axially;

each said inclined surface on said packer C-rings forming an inner shearable vertex portion extending radially inwardly past the inner end of the adjacent said cone C-ring, whereby the compressive force generated by relative axial movement of said upper and lower cones toward each other effects a shearing of said vertex portion of each said packer C-ring to produce a surface on each said packer C-ring snugly conforming to the adjacent one of said oppositely inclined surface on said upper and lower cones;

wherein said oppositely inclined surfaces on said upper and lower cones terminate at their radially inner ends in a surface orthogonal to said tubular body element, thereby defining therebetween an annular chamber of triangular cross-section; and a ring of extrusion resistant organic sealing material disposed in said annular chamber and compressible by deformation of said packer sleeve into sealing engagement with the exterior of said tubular body element.

3. A sealing assembly for a subterranean wall packing unit comprising, in combination:

a tubular body element;

a packing sleeve formed of a deformable organic material and snugly surrounding an axial portion of the exterior of said tubular body element;

upper and lower cones freely surrounding said tubular body element at opposite axial ends of said packing sleeve and having oppositely inclined, facing surfaces respectively axially spaced from said packing sleeve;

a pair of cone C-rings respectively cooperable with said oppositely inclined surfaces on said upper and lower cones to be urged radially outwardly and axially toward each other by relative axial movement of said upper and lower cones toward each other, said cone C-rings respectively having generally radial, facing surfaces;

a pair of packer C-rings respectively secured to and abutting said facing surfaces of said cone C-rings, whereby the axial and radial movements of said cone C-rings are transferred to said packer C-rings;

said packer C-rings having opposed inclined shearable surfaces respectively engageable with opposite axial ends of said packing sleeve, whereby axial movement of said upper and lower cones toward each other produce a compression of said packing sleeve to deform said packing sleeve radially and axially;

said oppositely inclined surfaces on said upper and lower cones terminating at their radially inner portions in a surface orthogonal to said tubular body element, thereby defining therebetween an annular chamber of triangular cross-section; and a ring of extrusion resistant, organic sealing material disposed in said annular chamber and compressible by deformation of said packer sleeve into sealing engagement with the exterior of said tubular body element.

4. The sealing assembly of claim 3 wherein said extrusion resistant organic sealing material comprises polyetheretherketone containing carbon fibers.

* * * * *